United States Patent [19]

Ikeno et al.

[11] 4,298,661

[45] Nov. 3, 1981

Best Available Copy

[54] SURFACE TREATED STEEL MATERIALS

[75] Inventors: Teruo Ikeno, Mitaka; Satoshi Kado, Fujisawa; Saburo Ayusawa, Funabashi; Hironobu Kawasaki, Machida; Takashi Watanabe, Ayase, all of Japan

[73] Assignee: Nippon Steel Corporation, Tokyo, Japan

[21] Appl. No.: 44,485

[22] Filed: Jun. 1, 1979

[30] Foreign Application Priority Data

| | | | |
|---|---|---|---|
| Jun. 5, 1978 | [JP] | Japan | 53-67465 |
| Jun. 5, 1978 | [JP] | Japan | 53-67466 |
| Jun. 30, 1978 | [JP] | Japan | 53-79357 |
| Jul. 20, 1978 | [JP] | Japan | 53-88640 |
| Nov. 22, 1978 | [JP] | Japan | 53-144439 |
| Nov. 22, 1978 | [JP] | Japan | 53-144440 |

[51] Int. Cl.[3] ..... B32B 15/04; B32B 15/18

[52] U.S. Cl. ..... 428/623; 428/626; 428/629; 428/632; 428/656; 428/659; 428/926; 428/935

[58] Field of Search ..... 148/31.5; 428/623-626, 428/628, 629, 632, 633, 655, 656, 658, 659, 926, 935; 204/40, 45.5, 57, 96

[56] References Cited

U.S. PATENT DOCUMENTS

| | | | |
|---|---|---|---|
| Re. 26,223 | 6/1967 | Smith et al. | 428/655 |
| 2,636,257 | 4/1953 | Ford | 428/628 |
| 2,637,896 | 5/1953 | Nachtman | 428/658 |
| 2,812,298 | 11/1957 | Hardoen | 204/96 |
| 3,065,155 | 11/1962 | Welsh | 204/96 |
| 3,671,205 | 6/1972 | Ucluda et al. | 428/623 |
| 3,752,708 | 8/1973 | Newell et al. | 148/31.5 |
| 3,900,385 | 8/1975 | Eva et al. | 204/96 |
| 3,960,610 | 6/1976 | Steinbrecher et al. | 148/31.5 |

FOREIGN PATENT DOCUMENTS

| | | | |
|---|---|---|---|
| 46-25608 | 7/1971 | Japan | 428/656 |
| 50-136243 | 10/1975 | Japan . | |
| 52-7333 | 1/1977 | Japan | 428/659 |
| 53-1643 | 1/1978 | Japan . | |

OTHER PUBLICATIONS

Dirnfeld, S., et al., "Manganese Diffusion Coating of Steels", *Journal of the Iron and Steel Institute*, pp. 670-674 (9/72).

Safranek, W. H., *The Properties of Electrodeposited Metals and Alloys—a Handbook*, Am. Elsevier Pub. Co., p. 213 (1974).

*Gmelins Handbuch der Anorganischen Chemie Mangan*, pp. 366-367 (1973).

*Primary Examiner*—Michael L. Lewis

*Attorney, Agent, or Firm*—Cushman, Darby & Cushman

[57] ABSTRACT

A surface treated steel materials coated with manganese having a film of MmOOH (manganic hydroxide) formed thereon, which show excellent corrosion resistance, workability and weldability. The surface treated steel materials may be further coated with zinc as a base coating underlying the manganese coating or further coated with a coating of at least one selected from the group consisting of P, B, Si, Cu, Mn, Cr, Ni, Co, Fe, Zn, Al, Ca, Mg, Ti, Pb, Sn, inorganic carbon and their compounds and still further coated with an organic coating. The film of MmOOH (manganic hydroxide) is formed by a treatment in an aqueous solution containing $Cr^{6+}$.

9 Claims, 10 Drawing Figures

SURFACE TREATED STEEL MATERIALS

BACKGROUND OF THE INVENTION:

1. Field of the Invention:

The present invention relates to surface treated steel materials having a manganese coating and MnOOH (Manganic hydroxide) formed electrolytically or chemically on the manganese coating, which steel materials show excellent corrosion resistance, workability and weldability, and to a process and an apparatus producing the same.

2. Description of Prior Arts:

As means for providing steel materials, the metallic coatings have been most widely used, and zinc-coated steel materials, in particular, have been and are used in tremendous amounts for manufacturing materials for buildings, automobiles, electric appliances and also used in the forms of wires and sections.

However, as zinc-coated steel materials have been increasingly used in various applications as mentioned above and under severe service conditions, a conventional single zinc coating or single metal coating has not always been able to satisfy requirements and recent trends are that a composite or alloy coating is applied to steel materials so as to improve the properties.

This is due to discoveries and knowledges obtained through long-year experiences that the corrosion protecting effect of zinc (or zinc alloy) based on its nature that it is electrochemically baser than iron, namely due to its sacrificial anodic action, cannot be maintained if the corrosive media is very severe and the dissolution of zinc is so rapid.

For example, referring to a painted galvanized iron, which has been widely used for building materials, a zinc-coated or alloyed zinc-coated steel plate is used.

However, the environments to which the zinc-coated or alloyed zinc-coated steel sheet is exposed usually contain corrosive media, such as water, oxygen and salts, so that the coated zinc dissolves in a very short period of service, thus developing red rust due to the corrosion of the base steel sheet, and further promoting the corrosion of the base steel sheet itself. Therefore, the zinc-coated steel sheet is seldom used without a further surface treatment.

Hereinbelow, mention will be made to steel plates for automobiles, for example. In U.S.A., Canada and European countries, salt is sprayed on highway roads in winter seasons for prevention of freezing of the roads, and the amount of salt to be sprayed has been steadily increasing each year. For this reason, corrosion of the automobile bodies has been an important problem, and the Canadian Department of Consumer and Corporate Affairs has proposed a general guidline in connection with corrosion of the automobile bodies as shown in Table 1 and calls for assistance from the automobile industry.

TABLE 1

Guideline for Corrosion Protection Proposed by Department of Consumer & Corporate Affairs, Canada

| | 1978 | 1979 | 1980 | 1981 |
|---|---|---|---|---|
| | year | year | year | year |
| No Rust | 1 | 1 | 1.5 | 1.5 |
| No Pitting | 3 | 3.5 | 4 | 5 |
| No damage on Structural Parts | 6 | 6 | 6 | 6 |

Meanwhile, the automobile industry has been practising the following corrosion protection measures:

(1) Improvements of pretreatments, such as degreasing and chemical conversion treatments, as well as substitution of the anion type electrodeposition coating;

(2) Improvement of corrosion protecting paints, particularly improvement of resistance to chipping;

(3) Employment of zinc-coated steel materials and zinc-rich paint precoated steel materials.

The measures of the above (1) are useless for portions such as door inner or pointed portions which are accessible to the pretreatments or electrodeposition coating, although effective for the outer skins. Also the measures of the above (3) have defects that when the amount of zinc coating is increased, for example, for improving the corrosion resistance, the weldability and the workability are damaged, while in the case of the precoating, the weldability and the corrosion resistance at worked portions are satisfactory. Therefore, up to now, no satisfactory steel materials are available which can well guarantee the Governmental guidelines shown in Table 1, particularly guarantee of "no pitting" and "no damage" for 5 to 6 years as aimed at in 1981.

Therefore, strong demands have been made for developments of new surface treated steel materials which show far better corrosion resistance than the conventional surface treated steel sheets and at the same time provide workability, weldability and paintability similar to those of ordinary cold rolled steel sheets, all together in a well balanced condition. Therefore, it is an urgent task for the steel industry to satisfy the above demands from the points of safety assurance and material savings.

The corrosive environments to which the automobiles are exposed usually contain corrosive substances, such as water, oxygen and salts, and automobiles are exposed over a long period of time to water and salt confined within their recesses. Therefore, when zinc-coated steel sheets are used in such environments, the coated zinc dissolves in a very short period of time and red rust is caused by the corrosion of the base steel sheet and in more severer cases pitting and damages of structural parts are caused. Thus in the corrosion of automobiles, there is a close relation among the temperature, humidity (time for which the automobile is kept in a wetted condition) and the salt content as has been confirmed by the present inventors. The test results are shown in Table 2 from which it is understood that the salt spray test (JIS-Z-2371) widely used in the steel industry provides the most severe corrosive condition, while the atmospheric exposure test provides the least corrosive condition, and thus the humidity is the most important factor.

TABLE 2

| | Comparison of Corrosion Rates ($g/m^2/year$) in Various Environments | | | | |
|---|---|---|---|---|---|
| | Atmospheric Exposure Test | 3% NaCl + Air Exposer Test | 5% $CaCl_2$ + 5% NaCl + 0.05% $Na_2SO_4$ + Air Exposure Test | Dry-Wet Repetition Test | Salt Spray Test |
| | Semi-Rural District | Once a day (15 min) 3% NaCl spraying followed by atmospheric exposure | Once a day 15 (min) spraying aqueous solution of above stated salts, followed by atmospheric exposure | Immersion into 3% NaCl for 5 min. drying at 50° C. for 25 min. | 3% NaCl 35° C. 100% R.H |
| Ordinary Steel | 280 | 1,440 | 10,500 | 8,000 | 7,800–11,800 |
| Zn | 15 | 60 | 3,000 | 180 | 6,000–8,640 |

In the salt spray test, zinc dissolves at a corrosion rate of about 1 $g/m^2/hr$ and if the corrosion resistance is relied solely on the anodic self-sacrificial corrosion protection of zinc, the zinc coating must be made in an amount as large as several hundred grams to one kilogram per square meter, and steel sheets with such a large amount of zinc coating canot be welded, ad the Fe-Zn alloy layer formed between the base steel and the zinc coating is very susceptible to cracking when subjected to workings, such as press forming. This cracking damages the corrosion resistance of such worked portions. Further, from the necessity of energy saving, efforts and trials have been made in reducing the weight of automobiles for the purpose of improving the fuel consumption ratio, and thus it is not desirable to increase the amount of zinc coating indefinitely.

What is more critical matter for the zinc-coated steel sheet is the problem of "contact corrosion" which is caused when the zinc-coated steel sheet is used in combination with an ordinary cold rolled steel sheet as often used in the automobiles. In the automobile industry, the zinc-coated steel sheet is used in combination with a non-coated cold rolled steel sheet into a white body, which is subjected to degreasing, washing, phosphate treatment, electrodeposition paint coating, intermediate coating and upper coating. In this way, when different metals, e.g. zinc and iron are brought into contact with each other in a wetted condition, a galvanic cell is formed between them and promotes dissolution of zinc and as the dissolution is promoted, swelling of the upper paint coating is caused, resulting in damgaes of the paint coating. Thus as shown in FIG. 1, (one sheet of 70×100 m/m (A) and another sheet of 70×90 m/m (B) were spot welded on two spots, uniformly paint coated and scratched), test pieces by combining a cold rolled steel sheet with a zinc-coated steel sheet by spot welding, and subjecting this combined sheet to a standard phosphate treatment, anionic electrodeposition coating and upper coating, and the test pieces were scratched by a knife cutting the paint coating to the base steel, subjected to 20-day salt spray test (JIS-Z-2371) and the adhesion of the paint coating near the scratched portions was determined by the tape stripping test. The results are shown in FIG. 2. It has been revealed that the adhesion of the paint coating, which is satisfactory good when a cold rolled steel sheet is combined with a cold rolled steel sheet, is definitely lowered near the welded portion between the zinc-coated steel sheet and the cold rolled steel sheet, and this lowered adhesion results in easy peeling-off of the paint coating.

Also zinc-coated steel products are usually subjected to a chemical conversion treatment, such as chromating and phosphating, fitted to the zinc coating, and further subjected to an organic coating compatible to the chemical conversion treatment for the purpose of improving the corrosion resistance and the ornamental value. However, even when the steel products are surface coated by zinc coating, chemical cnversion treatment and organic coating, the zinc coating is first attacked by a corrosive substance, such as water, oxygen and salt which penetrate through the organic coating, and the organic coating itself is damaged by the corrosion product.

As mentioned above, in the case when a zinc-coated steel material having an organic coating on the zinc coating, the corrosion resistance of the zinc coating itself is very important, just as when the zinc-coated steel material is used without an organic coating thereon, and for this reason the recent technical tendency is directed toward inhibition of the sacrificial anodic action of the coated zinc and commercial trials have been made to artificially make the galvanic electrode potential of the zinc coating approach to that of iron by alloying the zinc coating with iron, aluminum, nickel, molybdenum, cobalt, etc. resulting in developments of Zn-Fe alloy coated, Zn-Al alloy coated, Zn-Ni alloy coated, Zn-Mo-Co alloy coated steel products, which are now in the market.

These alloyed zinc coatings are said to have a corrosion resistance two or several times better than that of the conventional zinc coating, but the Zn-Fe alloy coating has difficulty in working, the Zn-Al alloy coating has difficulties in workability, weldability and paintability, and the zinc-nickel alloy coating is hard to obtain in a uniform structure and has a disadvantage that a continuous performance of spot welding is hardly achieved due to its low electric resistance as low as the zinc coating, thus failing to provide a coated material with satisfactorily balanced properties. Although the Zn-Mo-Co alloy coating seems to provide the desired balanced property, it is very difficult to form the alloy coating of uniform composition, because each of the component metals shows a different electrodeposition speed depending on the electroplating conditions.

Therefore, in recent years strong demands have been made in various fields for the balanced property, namely for a comercial development of a surface coated steel material having excellent workability and weldability as well as satisfactory paintability and adaptability to chemical conversion treatments, but up to now, there is no surface coated steel material which can meet with the above requirements.

For improving the corrosion resistance of a steel material by coating the steel material with other metals and utilizing the corrosion resistance of the coated metals, there are two groups of coating methods, as classified electrochemically; the first group in which a metal nobler than iron is coated, for example chromium plating; the second group in which a metal baser than iron is coated, for example, zinc plating. For the first group of methods, many studies have been made and many arts have been established. However, when the metal coating itself has pinholes, or when the thickness of a coating increases, the coating is susceptible to cracking, as seen in the chromium coating. In either case, the metal coating has a defective portion, so that the steel substrate is first attacked because iron is electrochemically baser than the coated metal, just contrary as in the zinc coating, so that pitting corrosion is apt to occur, thus deteriorating the reliability of the coated steel material.

In view of the above facts, it may be concluded that a metal, such as zinc, which shows the sacrificial anodic action is more advantageous for protecting steel materials from corrosion. The present inventors made systematic studies in consideration of the above technical points of view, and have found that among various coated steel materials, a manganese coated steel material having an MnOOH (manganic hydroxide) formed thereon shows the best corrosion resistance. As clearly understood from the galvaic series of metals in an aqueous solution, as manganese is electrochemically baser than zinc, it has been undoubtedly expected that manganese has an inferior corrosion resistance as compared with zinc.

Regarding the electrodeposition of manganese, many various studies have been made including "Electrolytic Manganese and Its Alloys" by R. S. Dean, published by the Ronald Press Co., 1952; "Modern Electroplating" by Allen G. Gray, published by John Willey & Sons Inc., 1953;"Electrodeposited Metals Chap.II, Manganese" by W. H. Safranek, published by Ammerican Elsevier Pub. Co., 1974, and "Electrodeposition of Alloys", Vol. 2 "Electrodeposition of Manganese Alloys" by A. Brenner, published by Academic Press, 1963.

According to R. S. Dean, the electrodeposition of manganese and its alloys act self-sacrificially anodically just as zinc and cadmium in the aspect of rust prevention, and a steel sheet having 12.5$\mu$ thick manganese coating can well resist to the atmospheric exposure for 2 years, and R. S. Dean reported by citing "Sheet Metal Industry", 29, p.1007(1952) that a satisfactory protective effect can be obtained by a thick manganese coating and that the electrolytic manganese becomes black when exposed to air, but this can be prevented by an immersion treatment in a chromate solution.

Further, according to N. G. Gofman, as reported in "Electrokhim Margantsa" 4, pp.125–141(1969), the electrodeposited manganese corrodes in the sea water at a rate by 20 times faster than zinc, but the corrosion rate of manganese can be decreased when a chromate film is provided on the manganese.

What is more interesting is reported by A. Brenner. He pointed out the following three defects of the manganese or its alloy coatings, although he mentioned a protective film for steels or low alloyed steels as one of the expected applications of the manganese or manganese alloy coatings.

(1) Brittleness
(2) Chemical reactivity (a short service life in an aqueous solution or outdoors)
(3) Dark color of corrosion products (unsuitable for ornamental purposes, yet suitable for a protective coating).

Regarding the brittleness, manganese electrodeposited from an ordinary plating bath, has a crystal structure of $\gamma$ or $\alpha$, and the $\gamma$ structure which is softer transforms into the $\alpha$ structure when left in air for several days to several weeks. Therefore, in practice, considerations must be given to the $\alpha$-manganese. In this case, the hardness and brittleness are said to be similar to those of chromium, i.e. 430 to 1120 kg/mm$^2$ expressed in microhardness according to W. H. Safranek.

Regarding the chemical reactivity, A. Brenner reported that the manganese or its alloys can be stabilized by a passivation treatment in a chromate solution, and the thus stabilized manganese or its alloys can stand satisfactorily stable for a long period of time in the indoor atmosphere, but he pointed out that for outdoor applications an eutectoid with a metal nobler than manganese should be used.

Therefore, judging from the fact that a zinc coated steel sheet with zinc coating of 500 g/m$^2$ by hot dipping can protect the steel sheet against corrosion for 30 to 40 years, a zinc coating of 90 g/m$^2$ by hot dipping which corresponds to a manganese coating of 12.5$\mu$ can be predicted to resist the atmospheric corrosion at least for 5 to 6 years, therefore a manganese coating which can resist to the atmospheric corrosion for only 2 years cannot be said to have a better corrosion resistance than a conventional surface treated steel sheet.

Up to now no trial or study has ever been made to improve the corrosion resistance of a steel material by manganese coating thereon, except for the invention made by the present inventors as disclosed in Japanese Laid-Open Patent Specifications Sho 50-136243 and Sho 51-75975.

The present invention is clearly distinctive over these prior arts in the following points.

The Japanese Laid-Open Patent Specification Sho 50-136243 discloses a surface treated steel substrate for organic coatings, which is obtained by electro-plating 0.2$\mu$ to 7$\mu$ manganese coating on the steel material, and by subjecting the manganese coated steel material to a chromate treatment or a cathodic electro-chemical treatment in a bath of aluminum biphosphate or magnesium biphosphate or both. The technical object of this prior art is to facilitate the conversion treatments by coating manganese because it is difficult to apply in substitution for zinc coating conversion treatments such as the chromate treatment and aluminum biphosphate and magnesium biphosphate treatments directly to the steel material, and also it has an object to improve the paintability and further the corrosion resistance.

The Japanese Laid-Open Patent Specification Sho 51-75975 discloses a corrosion resistant coated steel sheet for automobile, which comprising a steel substrate containing 0.2 to 10% chromium and at least one layer of coating of zinc, cadmium, manganese or their alloys in a total thickness of 0.02μ to 2.0μ. This prior art is based on the fact that when the chromium content exceeds 0.5%, the crystal formation on the surface becomes increasingly scattered during the phosphate treatment, for example, and when 3% or more of chromium is contained, completely no phosphate crystal is formed, so that an excellent corrosion resistance of a steel substrate can be obtained, and that it is effective to apply only on the steel surface a single layer or multiple layers of coating of zinc, cadmium, manganese or their alloys which are very reactive to the conversion treatments.

As explained above, the prior arts which were also made by the present inventors utilized the nature of manganese that it has a stronger chemical reactivity than zinc for improvement of applicability of a steel material to chemical conversion treatments, and provide a steel substrate for paint coating. Therefore, these prior arts are completely different from the present invention, in which the MnOOH (manganic hydroxide) is intentionally formed on the manganese coating electrolytically or chemically.

Thus the passivation obtained by the conventional chromate immersion is a kind of chemical conversion, just as the chromate treatment usually done on a zinc-coated steel sheet, which is intended to form a chromate film thereby improving the corrosion resistance. Therefore, a large amount of $Cr_{6+}$ or $Cr^{3+}$ naturally remains in the film. Contrary to this, the electrolytic or chemical treatment in chromic acid used in the present invention is not intended to form a film of $Cr^{6+}$ or $Cr^{3+}$, but is intended to intentionally promote conversion of the hydrated manganese oxide into the MnOOH(manganic hydroxide) as clearly shown from Table 3. Thus, no Cr ion can be detected in the film of oxyhydrated manganese compound even by the atomic absorption analysis.

The reason why the manganese coating in the prior arts exhibits excellent corrosion resistance is that the thin layer of the oxygen-containing manganese compound formed on the metallic manganese coating is hardly dissolved in water, and serves as a kind of passivated film and contributes to corrosion resistance as contrary to a pure manganese metal which is very reactive.

Thus when metallic manganese is electrochemically deposited using a usual sulfate bath, the metal manganese reacts with oxygen in the air, and manganese hydroxide formed in a thin film during the electro-plating is oxidized by the air and the oxygen-containing manganese compound is formed according to the following formulae (1) and (2).

$$2Mn(OH)_2 + O_2 \rightleftharpoons 2H_2MnO_3 \quad (1)$$

$$H_2MnO_3 + Mn(OH)_2 \rightleftharpoons Mn{\cdot}MnO_3 + 2H_2O \quad (2)$$

This oxygen-containing manganese compound hardly dissolves in a neutral salt solution or in water and provides a very stable corrosion resistant film, completely different from the metallic manganese.

An oxygen-containing metal compound, such as the oxygen-containing manganese compound, is known to contribute to corrosion resistance just as a stainless steel exhibits excellent corrosion resistance due to its passivated surface film of a hydrated oxide containing 20 to 30% water, and a thinly chromium coated tin-free steel exhibits excellent corrosion resistance and excellent paintability due to its oxyhydrated chromium compound film containing about 20% water. It is also known that the rust of steel exposed to the air for a long period of time contains non-crystalline oxyhydrated iron compound, FeOOH, and that the rust layer of an atmospheric corrosion resistant steel which exhibits excellent resistance to atmospheric corrosion contains much of such oxyhydrated iron compound.

SUMMARY OF THE INVENTION

Therefore, one of the objects of the present invention is to provide a surface treated steel material with excellent corrosion resistance, workability and corrosion resistance, which surface treated steel material has a manganese coating and MnOOH(manganic hydroxide) formed on the manganese coating.

Another object of the present invention is to provide a highly corrosion resistant organic coated steel material by applying a zinc coating as a base coating beneath the manganese coating having the MnOOH(manganic hydroxide) formed thereon.

Still another object of the present invention is to provide highly corrosion resistant steel materials suitable for organic coatings and an organic coated steel material produced by applying a coating of one or more of P, B, Si, Cu, Mn, Cr, Ni, Co, Fe, Zn, Al, Ca, Mg, Ti, Pb, Sn, inorganic C, and their composite compounds on the manganese coating having MnOOH(manganic hydroxide) formed thereon with or without a further organic coating thereon.

DETAILED DESCRIPTION OF THE INVENTION

Figure 1:
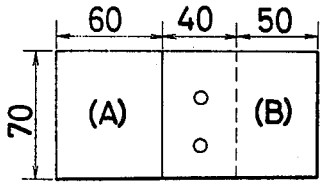
FIG. 1 shows the size and shape of a salt spray test piece taken from a spot welded portion.

As described hereinbefore, the corrosion resistance of the manganese coating is provided by the hydrated manganese oxide formed on the manganese coating and is not provided by the manganese coating itself, and the metallic manganese coating contributes to self-complementarily and continuously make up the gradual loss of the corrosion resistant film of hydrated manganses oxide in corrosive environments.

Therefore, when a steel surface is coated with manganese, washed and dried to form the hydrated manganese oxide on the manganese coating, a remarkable corrosion resistance can be obtained in corrosive environments due to the corrosion prohibiting effect of the hydrated manganese oxide.

However, what is the most important thing from practical points of view is the fact that surface treated steel sheets are very often subjected to surface treatments, such as phosphating and electrodeposition coating, which are fitted to ordinary cold rolled steel sheets, together with the ordinary cold rolled steel sheets in the same production line during their secondary and further subsequent forming steps as usually done in automobile or electrical appliance manufactures. For example, in the automobile industry, zinc-coated steel sheets are subjected to a phosphate treatment in which 2 to 3 $g/m^2$ of the coated zinc is dissolved, and subjected to an anionic electrodeposition coating in which 1 to 2 g/m$^2$ of the coated zinc is dissolved because the steel sheets act as an anode. Therefore, 3 to 5 g/m$^2$ of the coated zinc in total is lost by dissolution by these treatments.

The same thing can be said also to the manganese coating, and the amount of the coated manganese to be lost by dissolution is predicted to be larger than the loss of the zinc coating. In fact, it has been found by the present inventors that the dissolution of the manganese coating in the phosphate treatment reaches 3 to 4 g/m$^2$ and the dissolution in the anionic electrodeposition coating reaches 2 to 3 g/m$^2$.

The manganese coated steel sheet having an MnOOH(manganic hydroxide) film formed intentionally electrolytically or chemically on the manganese coating according to the present invention shows only 0.1 g/m$^2$ or less of the dissolution of the manganese coating in the phosphate treatment and an undetectably small amount in the anionic electrodeposition coating.

Therefore, as compared with the hydrated manganese oxide, the MnOOH(manganic hydroxide) film shows a very excellent resistance to dissolution in the phosphating treatment and in the anionic electrodeposition coating, for example. Thus, the manganese coated steel sheet having the MnOOH(manganic hydroxide) film formed thereon is clearly distinctive from the manganese coated steel sheet having a film of hydrated manganese oxide in their corrosion resistance and their differences revealed by physical and chemical measurements are shown in Table 3.

TABLE 3

Comparison between Hydrated Manganese Oxide and MnOOH (manganic hydroxide)

| | Hydrated Manganese Oxide Film | MnOOH (manganic hydroxide) Film |
|---|---|---|
| Generating Condition | After Manganese Coating, washing and rapid-oxidizing by heating | After manganese coating, immersion into 10% aqueous solution of chromic acid then washing and drying |
| Color tone | Interference color | Metallic luster |
| Thickness of the film | 400–1000A | 50–300A |
| Result of Electron Diffraction | $Mn_2O_3$ | non-crystalline |
| Result of Infrared Spectroscopic Analysis | 540–550<br>580cm$^{-1}$<br>($Mn_2O_3$) | 620cm$^{-1}$<br>(MnOOH) |
| Solubility | Soluble into aqueous solutions of phosphoric acid and of chromic acid, and during the anionic electrodeposition | Insoluble into aqueous solutions of phosphoric acid and of chromic acid, and during the anionic electrodeposition |
| Cr amount in the film | / | Not detectable by atomic absorption analysis |
| Supposed Rational Formula | $Mn \cdot MnO_3 + 2H_2O$ | MnOOH |

As clearly understood from the findings shown in Table 3, the manganese coated steel sheet having the MnOOH(manganic hydroxide) film formed on the manganese coating by immersion or electrolysis in an aqueous solution of chromic acid according to the present invention has a passivated film mainly composed of MnOOH which improves the resistance to phosphoric acid, etc., and provides a beautiful metallic luster so that the dissolution of the manganese coating in the phosphate treatment or in the anionic electrodeposition coating as practised in the automobile manufacturers and the electric appliance manufacturers can be effectively prevented, thus preventing the deterioration of these treatment solutions.

Therefore, the main feature of the present invention lies in that an MnOOH(manganic hydroxide) film is formed on the manganese coating by dissolving the hydrated manganese oxide, which has been formed merely by oxidation by air on the manganese coating, by immersion or electrolysis in an aqueous solution containing $Cr^{6+}$ so as to form a compact and high corrosion resistant MnOOH(manganic hydroxide) film, and this MnOOH(manganic hydroxide) film markedly enhances the corrosion protecting effect of the manganese coating. For continuous formation of the oxyhydrated manganese compound film on steel strips in steel makers, the conditions as shown in Examples 1 and 2 set forth hereinafter may be followed. This technical feature can be applied to all metals except for several metals, such as alkali metals and alkali earth metals, which are electrochemically baser than manganese, namely can be applied to metal alloys and their oxides which are electrochemically nobler than manganese and thus permit electrodeposition of manganese thereon. Therefore, the technical feature of the present invention can be widely applied except for the above few exceptions.

Also the present invention can be applied to all grades and forms of steel products including ordinary hot and cold rolled steel materials in various forms such as sections and wires, irrespective of their strength and corrosion resistance. Further, as a modification for further improving various properties such as corrosion resistance, an intermediate single or composite coating of a metal such as nickel, tin, aluminum, copper or alloys such as lead-tin or a metal oxide may be formed between the base steel and the manganese coating, and these intermediate coatings may be formed by electrolytic, chemical or mechanical means or by hot dipping or fusion.

Descriptions will be made on the thickness ranges of the manganese coating and the MnOOH(manganic hydroxide) film, which are main features of the present invention.

Regarding the manganese coating, the thicker coating is more preferable in view of the corrosion resistance to be expected. However, the important role of the manganese coating expected in the present invention is to self-sacrificially and continuously provide the Mn00H(manganic hydroxide) which is remarkably corrosion resistant through reaction with corrosive substances, such as water and oxygen in the corrosive environments. Therefore, it is necessary that the manganese coating, when applied directly to the base steel, is formed in a thickness enough to cover the base steel, and its thickness can be determined in view of the required corrosion resistance. As illustrated in the examples set forth hereinafter, it is preferable the manganese coating is formed in a thickness of not less than about 0.6$\mu$.

Meanwhile, the upper limit of the manganese coating, is set at 8$\mu$, because when the coating exceeds 8$\mu$, the hardness becomes too high due to formation of manganese hydride and hinders the workability.

Regarding the thickness of the film of MnOOH(manganic hydroxide) formed on the manganese coating, it varies depending on the conditions of electrodeposition, chemical or electrolytic treatments, but as revealed by measurements by an electron spectroscopy for chemical analysis or other methods, 50 to 300 Å is a preferable.

Another most advantageous property of the coated steel material with the manganese coating having the film of oxyhydrated manganese compound formed thereon is its excellent spot-weldability. Thus in the case of an ordinary zinc-coated steel material, when the zinc coating is about 30 g/m$^2$ (about 4$\mu$) or larger, the spot-weldability and electrode life lowers as compared with a cold rolled steel material without zinc coating. However, the coated steel material according to the present invention can be spot welded with the same conditions as the ordinary cold rolled steel material and as good as the ordinary cold rolled steel material in respect of number of weld. In this case, also, not thicker than 8$\mu$ of the manganese coating is preferable just as for the required corrosion resistance and workability. Therefore, the thickness range of the manganese coating as defined hereinbefore satisfies the requirement for the corrosion resistance, the workability and the weldability.

When other metals, alloys or metal oxides (for example, nickel, copper, tin, lead-tin, etc.) are coated on the base steel, the thickness of the manganese coating and the MnOOH(manganic hydroxide), particularly the thickness of the former to be applied on these intermediate coatings may vary because these intermediate coatings have their own rust preventing effects, but it is preferable the thickness is 0.5$\mu$ or thicker and regarding its upper limite, 8$\mu$ or less is enough.

It is generally known that when a steel plate is subjected to forming, such as stretching and deep-drawing, crackings are more apt to occur as the thickness of coating is increased, and in the case of a zinc coating applied by hot dipping, cracks easily take place from the iron-zinc alloy during the forming even when the zinc coating is not so thick.

Further, the metallic zinc has a low hardness as Hv62 so that it is easily scratched by the forming die during the forming operation and adheres to the die, thus often causing surface defects, such as press scratches, during the pressing.

The surface treated steel material with the manganese coating having the film of MnOOH(manganic hydroxide) according to the present invention shows excellent ability to adsorb press lubricants (for example, petroleum lubricants such as paraffin, and naphthene and non-petroleum lubricants such as animal and vegetable oils, and synthetic oils) used in the forming step, so that not only the forming such as deep-drawing is markedly facilitated, but also the electrode contamination in the subsequent spot-welding can be effectively prevented and other handling operations, such as coiling and piling, can be done smoothly. The above lubricant is applied in an amount ranging from 0.5 to 5 g/m$^2$.

Also, when the manganese coating having the film of MnOOH(manganic hydroxide) formed thereon is applied only on one side of the base steel material, the other side is utilized as a non-coated steel surface. This provides an advantage that the non-coated steel surface has excellent paintability and weldability so that a wider application of welding and working can be provided, as compared with the conventional surface coated steel plates, and when this one-side coated steel plate is used as automobile sheets and for electrical appliances where outer sides of the steel sheets are painted for ornamental purposes, great advantages can be obtained. In this case, the non-coated side may be applied with rust preventive oils as specified by JIS NP3.

As a modification of the present invention, when zinc is coated on the base steel as an under-coat for the manganese coating, further improvements of workability and weldability can be obtained.

Thus, when the zinc coating is provided on the base metal, it is possible to protect electrochemically the base metal in a wet and corrosive environment where corrosion factors such as oxygen and water in particular are participated, and the manganese coating applied on the zinc coating inhibits the dissolution of the zinc coating, thus elongating the service life of the zinc coating, and has an advantage that it does not promote corrosion of the base steel and the zinc coating because manganese is an electrochemically baser metal.

The manganese coating has a further remarkable advantage that its effect on the electrode consumption during welding is very small as compared with the conventional surface coated steel materials. In this way, the duplex coating of zinc-manganese can provide a high degree of corrosion resistance unexpectable from the conventional surface coated steel materials. For example, in the case of the conventional single coating of a metal such as chromium and aluminum, it is impossible to avoid occurrence of pin holes, and when the thickness of coating is increased so as to eliminate the pin holes, the coating layer is put under stress and cracks, thus failing to give the expected effect of an increased thickness of the coating, and still to worsen, the increased thickness of coating often causes serious problems in connection with workability and weldability, and these problems have never been solved.

Now according to the present invention, it is possible to satisfy various requirements by a thin coating thickness unconceivable from the conventional coatings by combination of the zinc coating and the manganese coating in a technically reasonable way. The under coating of zinc functions to prevent the layer of manganese and MnOOH(manganic hydroxide) from corrosions due to pin holes, working scratches, and other various surface damages, and the manganese coating having the MnOOH(manganic hydroxide) film thereon provides a strong protection against the corrosive environments, and these advantageous effects of the zinc coating and the manganese coating are combined in the modification of the present invention. Further, the steel material coated with a duplex coating of zinc and manganese having the MnOOH(manganic hydroxide) film formed thereon can be spot-welded at a low current as compared with a zinc-coated steel material, because the manganese coating having the MnOOH(manganic hydroxide) film shows a high electric resistance, and suffers from less expulsion and surface flash, thus very advantageous in respect of the electrode consumption. It has been found by the present inventors that the surface treated steel material according to the above modification of the present invention shows spot-weldability and continuous welding performance as good as the ordinary cold rolled steel sheet.

As described hereinabove, the other remarkable advantage of the surface treated steel material according to the present invention is that excellent spot-weldability can be obtained. In this case, not thicker than 8$\mu$ of the manganese coating which provides the required corrosion resistance and workability is preferable.

Regarding the thickness of the under coating of zinc (or alloyed zinc) a lower limit of not less than 0.4μ is preferable for the corrosion resistance and an upper limit of not more than 8.4μ is preferable in view of the workability, weldability, etc.

The zinc coating and the manganese coating can be easily performed by the following methods.

The zinc coating can be made by hot dipping or electroplating, but the latter method is more advantageous when more importance is given to the workability and weldability. When the zinc coating is made by electroplating conventionally known sulfate bath and chloride bath may be used, and a zinc-base alloy coating or a dispersion coating can provide satisfactory functions as required by the under coating. Also when the zinc coating is made by hot dipping, the ordinary method can be applied without modification, and an alloyed zinc coating made by adding various elements in the zinc bath can provide a satisfactory under coating just as by the electroplating.

Also the galvannealed (Zn-Fe alloy coated) steel plate obtained by heat treating a zinc coated steel sheet can also be used as the base metal. In this case, the thickness of the alloyed coating is preferably not larger than 8.4μ for the reasons set forth hereinbefore.

The manganese coating can be easily made by electroplating either in a sulfate bath or a chloride bath.

According to a further modification of the present invention, a coating of one or more of P, B, Si, Cu, Mn, Cr, Ni, Co, Fe, Zn, Al, Ca, Mg, Ti, Pb, Sn and inorganic C, or one or more of their composite compounds is applied on the manganese coating having the MnOOH(-manganic hydroxide) film thereon, and if necessary, an organic coating is further applied thereon.

According to still another modification of the present invention, a coating containing one or more of composite compounds of one or more of P, B, Si, Cu, Mn, Cr, Ni, Co, Fe, Zn, Al, Ca, Mg, Ti, Pb, Sn and inorganic C and an organic resin is applied on the manganese coating covered with the MnOOH(manganic hydroxide) film, and if necessary, an organic coating is further applied thereon.

Presently, paint coated steel sheets or wires prepared by coating a paint on zinc-coated steel sheets have been widely used as materials for roofs, walls, fences and so on. These paint coated steel products have found a wide field of their applications, because of their beautiful surface colors and corrosion protection deriving from the surface paint coatings. In most cases, the zinc coating is applied as an under coating, because satisfactory corrosion resistance can not be assured by applying the paint coating directly on the base steel. The intermediate zinc coating under the paint coating acts as a self-sacrificial anode to the base steel and thus electrically prevents corrosion, hence preventing the formation of red rust and elongating the service life of the paint coated steel materials.

However, the paint coatings are less harder than the steel so that the paint coated steel materials are very susceptible to surface scratches during their forming, handling or actual service, and in many cases the scratches go through the paint coating to reach the base metal. The zinc coating at the scratched portion will be directly exposed to the corrosive atmosphere to produce a corrosion product which is porous and less protective, and also shows only a lowered electric corrosion protection effect to iron as compared with the metallic zinc. Therefore, in cases where the zinc coating is thin, the base iron is easily corroded to generate red rust. If the zinc coating is covered with a paint coating, the paint coating prevents corrosive substances, such as water, oxygen, chloride ion entering from outside so that the corrosion of the zinc coating is delayed. However, the corrosion of the zinc coating at the surface scratched portion is accelerated as revealed by salt spray tests. This is one important defect from which all surface coated steel materials including the zinc coated steel material suffer, and many trials have been made to overcome this defect, including improvements of pretreatments prior to the paint coating, increase of the thickness of the paint coating, development of paint coatings less susceptible to scratching, and increase of the amount of zinc coating. All of these trials have never made consideration to replace the zinc coating itself, thus the properties of zinc were maintained. Therefore, a basic solution of the defect has never been provided by these trials.

The present inventors have made various extensive studies and found that the red rust formation at the surface scratched portions can be completely prevented by replacing the zinc coating with a manganese coating covered with an MnOOH (manganic hydroxide) film, and further discovered that the advantages inherent to the manganese coating can be fully utilized by forming a suitable intermediate layer between the base steel and the manganese coating covered with the MnOOH (manganic hydroxide) film.

Thus, particularly in cases where the zinc coating is applied in a thin thickness, the generation of red rust is caused by the fact that the corrosion product of Zn is porous and less protective and shows less electric corrosion protection to Fe as compared with the metallic Zn, as mentioned hereinbefore. Contrary to this, the corrosion product of manganese is compact and provides a strong protecting effect, and also a strong electrochemical protection to Fe so that the formation of red rust in the surface scratched portions can be remarkably prevented. Also when metals, such as Ni and Cu which have a nobler potential than Fe are coated, the formation of red rust at the surface scratched portions is quicker than when the zinc is coated, because corrosion of Fe is accelerated by these metals. On the other hand, the metalic manganese and the corrosion product of manganese usually have a baser potential than Fe, so that Fe is electrochemicaly protected even at the surface scratched portions.

As mentioned hereinbefore, the MnOOH (manganic hydroxide) film in the present invention gives a diffused pattern when analized by the electron beam diffraction, but its existence has been confirmed by the infrared spectroscopic analysis, and is supposed to have a rational formula of MnOOH. So far as the corrosion resistance at the surface scratched portions is concerned, the corrosion resistance provided by the manganese coating covered by the MnOOH (manganic hydroxide) is not substantially different from that provided by the manganese coating alone, because the scratches go through the MnOOH (manganic hydroxide) film to the manganese coating. However, when a suitable intermediate coating exists between the base steel and the manganese coating covered with the MnOOH (manganic hydroxide), remarkable effects for preventing the swelling of the paint coating free from scratches and for preventing the red rust on the surface scratched portions can be obtained as described in details hereinafter.

At the portions free from scratches, the zinc coating can show considerably good corrosion resistance, but zinc is an active metal and reacts with water, oxygen and so on which transmit through the paint coating applied directly on the zinc coating, resulting in the swelling of the paint coating. Therefore, pretreatments are usually performed prior to the paint coating and the phosphate treatment is commonly used for this purpose. Thus when a phosphate film is formed on the zinc coating and then a paint coating is given on the zinc coating, the swelling of the paint coating in corrosive environments can be prevented and the corrosion resistance is markedly improved. Regarding the protecting mechanism of the phosphate film various studies have been made, and many hypotheses including "theory of anchor effect" have been made, but as yet there is no established theory therefor. The present inventors have conducted various experiments and discovered that the swelling of the paint coating in corrosive environments can be effectively prevented by forming a suitable intermediate layer between the base metal and the manganese coating, especially when the manganese coating is applied as an under coat for the paint coating.

Meanwhile, when the manganese coating is covered by the MnOOH (manganic hydroxide) film, the swelling of the paint coating can be prevented even if the paint coating is applied directly thereon. However, in order to prevent the swelling of the paint coating after a long period of service, a suitable intermediate layer is required.

As the suitable intermediate layer to be formed on the manganese coating, or on the manganese coating covered by the MnOOH (manganic hydroxide) film, a coating of one or more of P, B, Si, Cu, Mn, Cr, Ni, Co, Fe, Zn, Al, Ca, Mg, Ti, Pb, Sn and inorganic C or one or more of their composite compounds, and a similar coating further containing an organic resin has been found advantageous according to experiments conducted by the present inventors.

Further, it has been found that when the manganese coating is applied in combination with a suitable intermediate layer as an under-coat for a paint coating, better prevention of the red rust formation at portions without surface scratches can be obtained as compared with the zinc coating.

In this case, in spite of the paint coating and the intermediate layer, corrosive substances, such as water, oxygen and chloride ion, permeate through the spaces between the paint coating and the intermediate layer and cause corrosion as the time elapses. The better corrosion resistance is provided by the manganese coating than by the zinc coating due to the difference in the protecting effect on the base steel by their corrosion products.

More detailed explanations will be made in this point. When the underlying manganese coating is exposed due to scratches of the paint coating, it forms a compact film of corrosion product and provides electrochemical protection to prevent the formation of red rust. Also at portions covered by a sound paint coating, the corrosion product film shows the protecting effect. A larger amount of the manganese coating is more advantageous for the corrosion resistance, but a preferable range is from 0.6$\mu$ to 8$\mu$.

If the film of MnOOH (manganic hydroxide) exists on the manganese coating, it contributes to inhibit penetration of water or oxygen, etc. from outside and prevents the formation of red rust after a long period of use particularly at the portions covered by a sound paint coating free from scratches. When a suitable intermediate layer exists, the swelling of the paint coating can be effectively prevented. A preferable range for the thickness of the oxyhydrated manganese compound is 50 to 300A.

The intermediate coating between the manganese coating and the paint coating or between the film of MnOOH (manganic hydroxide) and the paint coating is effective to prevent the swelling of the paint coating caused by reaction between the active Mn and water, oxygen or other corrosive substances. The intermediate coating may be composed of one or more of P, B, Si, Cu, Mn, Cr, Ni, Co, Fe, Zn, Al, Ca, Mg, Ti, Pb, Sn and inorganic C, or one or more of their composite compounds. The compounds of the above elements may be exemplified as below.

The phosphorous compound: zinc phosphate, iron phosphate, iron-zinc phosphate, calcium phosphate, manganese phosphate, nickel phosphate, copper phosphate, zinc pyrophosphate, aluminum biphosphate, etc.

The boron compound: boron oxide, manganese borate, iron borate, etc.

The silicon compound: sodium silicate, potassium silicate, calcium silicate, calcium silicofluoride, silicon oxide.

The copper compound: copper oxide, copper hydroxide, etc.

The manganese compound: manganese oxide, manganese hydroxide and organic manganese salts such as manganese gallate and manganese oxalate.

The chromium compound: chromium oxide, chromic chromate, zinc chromate, silver chromate, lead chromate, barium chromate, manganese chromate, etc.

The nickel compound: nickel oxide, nickel hydroxide, etc.

The cobalt compound: cobalt oxide, etc.

The iron compound: iron gallate etc.

The zinc compound: zinc oxide, zinc hydroxide and organic zinc salts, such as zinc oxalate, zinc nicotinate, zinc tartrate, etc.

The aluminum compound: aluminum oxide, aluminum oxalate, aluminum hydroxide, etc.

The calcium compound: calcium oxide, calcium oxalate, calcium tartrate, calcium hydroxide, etc.

The magnesium compound: magnesium oxide, magnesium oxalate, magnesium hydroxide, etc.

The titanium coumpound: titanium oxide, etc.

The lead compound: lead oxide, etc.

The tin compound: tin oxide, stannic acid, etc.

The inorganic carbon compound: zinc carbonate, basic zinc carbonate, manganese carbonate, basic manganese carbonate, etc.

A preferable upper limit of the amount of the intermediate coating is 10 g/m$^2$ for P, B, Si, Cu, Mn, Cr, Ni, Co, Fe, Zn, Al, Ca, Mg, Ti, Pb, Sn and inorganic carbon all together. Regarding the lower limit, it is enough to satisfy at least one of the following four conditions.

(1) 0.02 g/m$^2$ or more in total for one or more of B, Si, Cu, Mn, Ni, Co, Fe, Zn, Al, Ca, Mg, Ti, Pb and Sn
(2) 0.01 g/m$^2$ or more for P
(3) 0.3 mg/m$^2$ or more for Cr
(4) 0.4 mg/m$^2$ or more for inorganic carbon If the intermediate coating contains an organic resin, this organic resin contributes not only for forming a protective film but also for closely adhering the compounds of P, B, Si, Cu, Mn, Cr, Ni, Co, Fe, Zn, Al, Ca, Mg, Ti, Pb, Sn and inorganic carbon to the manganese coating or to the film of MnOOH (manganic hydroxide). As for the organic resin, rosin derivatives, phenol resin, melamine resin, vinyl resin, polyester resin, urea resin etc. may be used. The amount of these resins to be contained in the intermediate coating should be preferably in a range from 0.02 to 10 times of the chromium content in an intermediate coating containing not less than 0.3 mg/m$^2$ of Cr, and in a range from 0.01 to 20 times of the total contents of P, B, Si, Cu, Nm, Ni, Co, Fe, Zn, Al, Ca, Mg, Ti, Pb, Sn and inorganic carbon in an intermediate coating containing 0.3 mg/m$^2$ or less of chromium.

As for the uppermost coating on the paint coated steel material which restricts the penetration of corrosive substances, such as water and oxygen and which inhibits the corrosion, a mixture of boiled oil, synthetic drying oil, natural and synthetic resins, cellulose resin with or without pigment and plastisizer may be coated preferably in a thickness ranging from 0.2 to 500μ.

The steel material used in the present invention includes carbon steels, low-alloy steels in various forms, such as plate, sheet strip, section, wire, bar, pipe and concrete reinforcing wire.

Also, the manganese coating may be applied directly on the base steel material, or may be applied on zinc coating, Fe-Zn alloy coating, Al coating, or the like, which has been applied on the steel material. Further, the manganese coating may be of pure manganese or manganese alloy containing less than 1% of a metal, such as Zn, Cd, Ni and Fe. The function of the film of MnOOH (manganic hydroxide) is identical, whether it is formed on the pure manganese coating or on the manganese alloy coating.

Meanwhile, a petroleum oil, such as paraffin oil and naphthene oil, or a non-petroleum oil, such as a vegetable or animal oil, or a synthetic oil may be coated on the surface treated steel material according to the present invention so as to improve the lubricity, thus markedly improving the press forming property in the case of a thin sheet, for example.

Hereinbelow, descriptions will be made on the process for producing the steel material coated with the manganese coating having the film of MnOOH (manganic hydroxide) formed thereon according to the present invention.

The steel material is first coated with 0.4 to 8μ manganese coating by electroplating. For the plating bath, a sulfate bath and a chloride bath are advantageous. The typical compositions and bath operation conditions of these bathes are shown below:

| | |
|---|---|
| The sulfate bath: | |
| Manganese sulfate | 80–200 g/l |
| Ammonium sulfate | 40–120 g/l |
| Ammonium rhodanide | 20–100 g/l |
| Bath temperature | 10–60° C. |
| pH | 2–10 |
| DK | 5–100 A/dm$^2$ |
| The chloride bath: | |
| Manganese chloride | 200–400 g/l |
| Ammonium chloride | 100–300 g/l |
| Potassium phodanide | 1–20 g/l |
| Ammonium rhodanide | 1–20 g/l |
| Bath temperature | 10–50° C. |
| pH | 3–9 |
| DK | 5–100 A/dm$^2$ |

The bath compositions and the operation conditions will slightly vary depending on the thickness of coating to be obtained, but generally for a high speed plating, it is necessary to increase the bath concentration and the current density and it is also necessary to forcedly stir or circulate the bath.

When the coating is less than 0.4μ, the corrosion resistance obtainable after the formation of the film of MnOOH (manganic hydroxide) (stabilization treatment) is not satisfactory. On the other hand, when the coating is 0.4μ or thicker, a satisfactory ballanced property can be achieved in spite of the loss of the film during the stabilization treatment.

As the electrode, a non-soluble anode, such as of carbon and titanium-platinum may be used, and metallic manganese itself may be used as a soluble anode.

Needless to say, when the electrode is positioned in the bath each opposing to each of the surfaces of the steel materials to be plated, both sides of the steel material can be easily plated, and when the electrode is positioned only on one side of the steel material to be plated, a one-side plated steel material can be obtained.

The manganese deposited from the above bath compositions is remarkably active and chemically reactive. Therefore, the surface of the coating is oxidized immediately after the plating by water contained in the environment and by air to form an oxide film covering the coating. This is very important when the surface stabilization treatment after the plating is intended to utilize the manganese coating as a corrosion preventing film.

The quality of a manganese coated steel material depends largely on the surface stabilization treatment which is performed after the plating, because various factors during the electroplating in a sulfate bath or a chloride bath have considerable influence on the surface oxidation. This surface stabilization treatment has also considerable effects on the paintability, weldability and workability of the final product.

As described above, the thickness of the oxide film which is formed on the surface of the manganese coating after the plating varies depending on the plating conditions and the appearance and color tone of the film vary depending on the washing conditions which is done after the plating, and therefore it is preferable to perform a rapid drying immediately after the washing following the plating.

By the rapid drying, a compact oxide film is formed to some degrees on the surface of the manganese coating and the surface is stabilized. However, when the film of MnOOH (manganic hydroxide) has been already formed before the rapid drying, the surface is more stabilized by the rapid drying and the surface quality, such as corrosion resistance and paint adhesion, can be improved. The formation of the film of MnOOH (manganic hydroxide) can be achieved by immersion or electrolysis in an aqueous solution containing at least 5 g/l or more of $Cr^{6+}$ ion. In this case, the lower limit of 5 g/l for the $Cr^{6+}$ ion concentration is essential, below which a compact corrosion resistance film of MnOOH (manganic hydroxide) can not formed. Regarding the upper limit of the $Cr^{6+}$ ion concentration, it can be effectively raised up to a concentration at which it saturates at the treating temperature. In the case of the immersion treatment, the desired result can be obtained by 1 to 10 seconds immersion at ordinary temperatures.

The stabilization treatment can also be easily performed by a spray treatment in substitution for the immersion treatment, and the treatment can be completed in a shorter time. A higher bath temperature produces a more effective treatment.

In the case of the electrolytic treatment, at least 2 $A/dm^2$ of current density is required, and a cathodic treatment is most advantageous, but an electric treatment with AC or AC and DC alteration may be applied. After the stabilization treatment and the subsequent washing and drying, the manganese coating thus treated is markedly stable and far less susceptible to the environments as compared with the manganese coating as plated.

The stabilized film of MnOOH (manganic hydroxide) thus formed contains no $Cr^{6+}$ ion and is composed of compact MnOOH (manganic hydroxide). Also this stabilized film has an ability to adsorb oils and fats. Thus if oil or fat is coated on the manganese coating after the stabilization treatment, the corrosion resistance as well as the workability and weldability can be further improved, so that a highly corrosion resistant coated steel material having an excellent general property can be obtained.

As for the oils and fats to be coated, all conventionally known rust preventing oils and lubricants such as glycerin esters of fatty acid, petroleum hydrocarbon oils and wax-dispersed water rust preventing oils can be used. The amount of the oils or fats to be coated must be not less than 0.1 $g/m^2$, below which no improvements of workability and weldability can be assured. On the other hand, coating amounts exceeding 5 $g/m^2$ give no further improvements, but are rather disadvantageous because the coating becomes very sticky. Therefore, a preferable range is from 0.5 to 5 $g/m^2$. The coating may be effectively done by roll coating, spraying or electrostatic coating.

Hereinbelow, descriptions will be made on an apparatus for producing the surface treated steel material according to the present invention referring to FIGS. 3 to 8.

Figure 3:
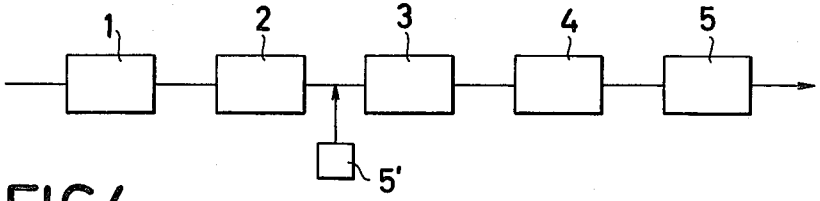
FIGS. 3 to 8 show schematically examples of apparatus for producing the surface treated steel materials according to the present invention.

In FIG. 3, a manganese plating device, 1, a washing device 2, a device 3 for producing the MnOOH (manganic hydroxide), a washing device 4 and a drying device 5 are successively arranged to constitute a continuous coating apparatus train.

The device 3 for producing the MnOOH (manganic hydroxide), arranged after the washing device 2, is capable of performing a chemical treatment or an electrolytic treatment. For the chemical treatment, the device 3 is so designed to bring the steel material into contact with the solution for forming the MnOOH (manganic hydroxide) for a predetermined period of time by spraying or immersion, and as the compound can be formed by several seconds contact with the solution at a bath temperature ranging from 20° to 40° C., a tank length of several meters at the line speed of 100 m/minute is enough for the purpose.

In the case of the electrolytic treatment, the device has almost identical functions as the plating device, with electrodes being arranged opposing to corresponding surfaces of the steel material, and the solution for producing the oxyhydrated compound filling the space between the electrodes. The electrodes are operable with varying current densities, and is designed to be operable only one side thereof. The washing device 4 is to remove the solution adhering to the steel material in the device 3 and is similar to the washing device 2.

The drying device 5 following the washing device 4 is designed to dry the steel material to such a degree that the subsequent coiling and piling can be done smoothly, and may employ gas, electric or heat rays heating.

In some cases, a drying device 5' similar to the drying device 5 may be arranged between the washing device 2 and the device 3 so as to remove the washing liquid.

Figure 4:
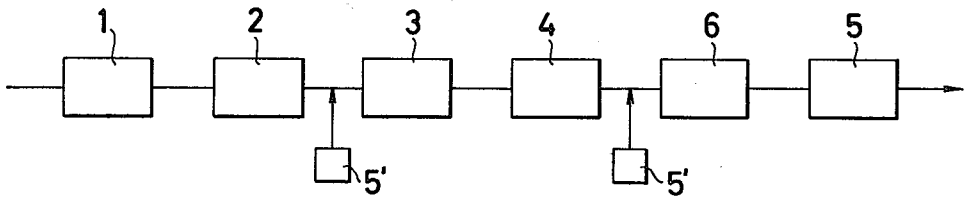
Figure 5:
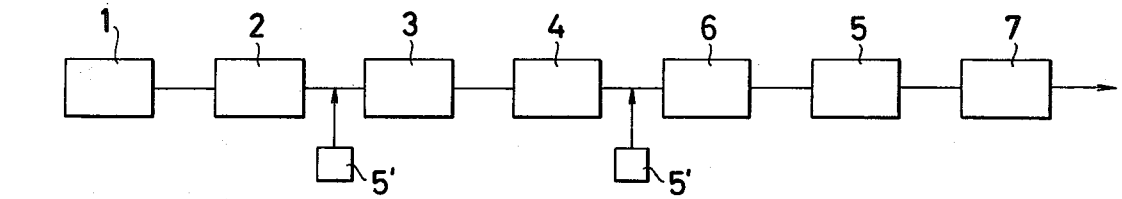
Figure 6:
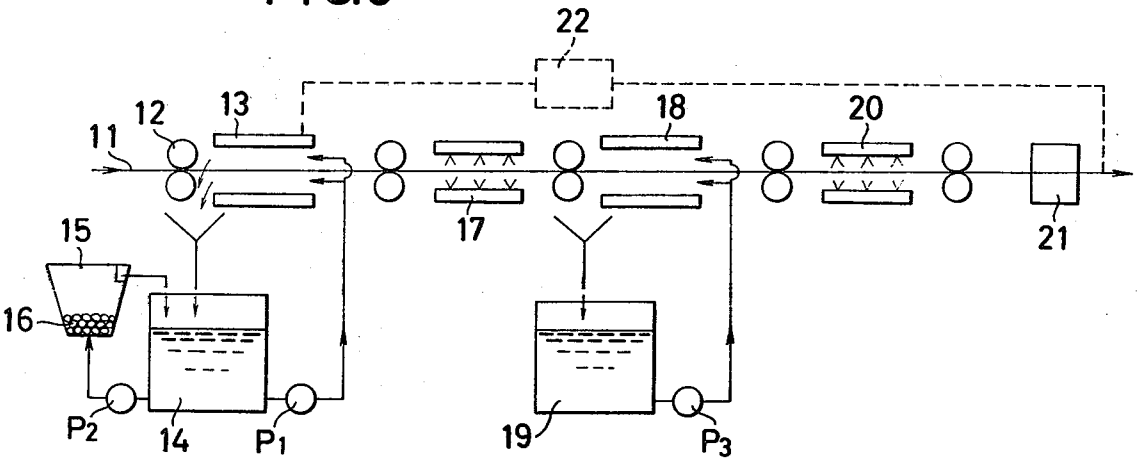
Figure 7:
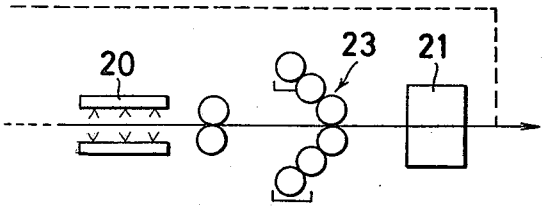

According to a modification shown in FIG. 4, a paint coating device 6 is positioned after the washing device 4, and this coating device 6 may be of spraying type, roll coater type, or of immersion type.

As for the paint to be coated, it may be a paint mainly composed of natural or synthetic resins, such as acrylic resin, epoxy resin, and may contain inorganic or organic pigments or rust preventing agents.

Further, if necessary, a drying device 5' for removing the washing water may be provided between the washing device 4 and the coating device 6.

More detailed descriptions of the apparatus will be made hereinafter.

The steel strip 11 is introduced through the rolls 12 into an electric manganese plating tank 13 in which a non-soluble electrode is arranged in a plane parallel to the steel strip. The non-soluble electrode may be made of Pb, C, Ti or Pt, but when a sulfate bath is used for the manganese plating, a Pb electrode containing a few percents of Sn or Sb is more stable and is operable in a wider bath temperature range than a pure Pb electrode. The electrolyte is circulated from the storage tank 14 through a pump $P_1$ to the plating tank 13, and to the storage tank 14. If the plating is done continuously for a long period of time $Mn^{+2}$ ion in the circulating electrolyte becomes short. Therefore, $Mn^{+2}$ ion is made up be supplying a manganese source 16, such as metallic manganese particles, and manganese carbonate powder, to the electrolyte in a dissolving tank, where the manganese source is dissolved in the electrolyte under stirring. Thus, the concentration of manganese in the electrolyte, the pH value of the electrolyte, and the level of the electrolyte for controlling the amount of the electrolyte are detected in the storage tank 14 by detecting elements. When the shortage of $Mn^{+2}$ is detected, the pump $P_2$ is automatically actuated through a controlling mechanism to send the electrolyte from the storage tank 14 to the dissolving tank 15, where the electrolyte dissolves the manganese source 16, such as metallic manganese particles or manganese carbonate powder, charged in the tank to provide an electolyte containing a high concentration of $Mn^{+2}$ ion and thus replenished electrolyte is returned to the storage tank 14. The amount of the manganese coating to be applied on the steel strip is restricted by controlling the amount of current given to the rolls 12 and the electrode in correspondence to the line speed by means of a controlling device 22. Other factors which are usually controlled in an electrolytic plating are controlled by suitable control mechanisms.

The steel strip on which manganese coating is applied is removed of adhering excessive electrolyte through squeezing rolls and introduced into the rinsing tank 17 where washing with cold or hot water is done by spraying or immersion, and if necessary a brushing device is used. Then the steel strip is again removed of excessive rinsing water through squeezing rolls and if necessary, introduced into a heating and drying furnace and then into the tank 18 for producing the MnOOH (manganic hydroxide).

In the MnOOH (manganic hydroxide) forming tank 18, the manganese coating on the steel strip is subjected to an electrolyte or chemical treatment in an oxidizing aqueous solution to form MnOOH (manganic hydroxide) having a metallic luster. For the treatment, an immersion treatment or an electrolytic treatment in an aqueous solution composed mainly of hexavalent Cr is preferable, but the treatment may be done in a phosphate solution containing an oxidizing substance witha controlled pH value.

The controlling mechanism for controlling the bath concentration and circulation may be almost the same as that adopted in the manganese electroplating, 19 represents a storage tank for storing the treating liquid for forming the MnOOH (manganic hydroxide) and $P_3$ represents a pump for sending the liquid.

When an electrolytic treatment is performed in the MnOOH (manganic hydroxide) forming tank 18, a non-soluble electrode or electrodes are provided in the tank, and a similar current controlling mechanism as in the manganese electroplating is provided, so as to control the current in correspondence to the line speed.

After the MnOOH (manganic hydroxide) film is formed, the steel strip is removed of the excessive treatment liquid adhering thereon by means of squeezing rolls, and then the still remaining treatment liquid is washed off with cold or hot water in the washing tank 20. If an aqueous solution containing hexavalent Cr is used for the treatment, the washing is done so as to completely remove the adhering Cr. Further, the steel strip is removed of the excessive washing water through squeezing rolls and introduced into the heating and drying furnace 21. It is sufficient only to dry the water adhering on the strip surface in the furnace. Therefore, the heating capacity of the furnace may be enough if it can heat the steel strip to a temperature ranging from 40° to 60° C. at the highest line speed, and if it functions merely as an ordinary drying furnace.

In FIG. 4, showing a further modification of the apparatus, a coating device 23 for continuously coating an organic coating on the film of MnOOH (manganic hydroxide) is provided in the apparatus train, which apparatus comprises a manganese electroplating tank 13 provided with a manganese supplying source, a washing tank 17, an MnOOH (manganic hydroxide) forming tank 18, a washing tank 20, an organic coating device 23 and a heating and drying furnace 21 arranged in the written order.

When a water-soluble or water-dispersion paint which is favourable to the shop environments is continuously coated by the organic coating device 23, the coating may be performed on the strip surface as still wetted with water. Therefore, the organic coating device may be arranged immediately after the washing tank 20. Meanwhile, when a solvent-soluble paint is continuously coated by the coating device, a drying furnace is required after the washing tank 20 so as to dry the remaining water, and thus the organic coating device 23 is arranged after the drying furnace. The organic coating device may be an ordinary roll coater or a curtain-flow coater. However, when the coating is done by electrodeposition, the tank is provided with rolls for passing the current to the steel strip as well as an electrode therein, and the washing tank is arranged after the electrodeposition tank.

After the organic coating is applied, the steel strip is introduced into the heating and drying furnace 21, where it is baked. The heating capacity of the furnace 21 must be enough to fully dry and bake the organic coating, but it is enough to heat the steel strip up to about 260° C. at the highest line speed.

Figure 8:
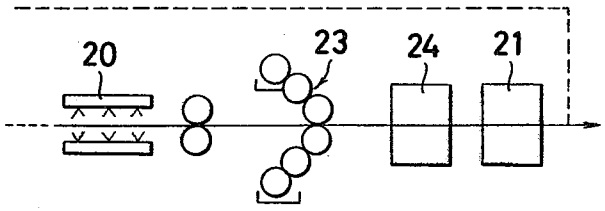

A still further modification of the apparatus shown in FIG. 3 or FIG. 4 comprises an oil coating device 24 arranged at the last of the apparatus train as shown in FIG. 8. The lubricant to be coated by this oil coating device may be a usual petroleum (paraffin or naphthene) or non-petroleum (animal, vegetable or synthetic oil) lubricant and the device may be of an ordinary type, such as a mist-spraying type and an electrostatic coating type.

DESCRIPTION OF PREFERRED EMBODIMENTS

EXAMPLE 1

Cold rolled steel strips of 0.8 mm thick were manganese plated in various thicknesses in an electrolytic bath (pH 4.2) of 100 g/l of manganese sulfate, 75 g/l of ammonium sulfate, and 60 g/l of ammonium thiocyanate at a bath temperature of 25° C., a current density of 20 $A/dm^2$ and with a lead electrode. After the electroplating, the coated strip were subjected to a cathodic electrolytic treatment in 5% chromic acid anhydride aqueous solution for 1 to 5 seconds at 2 $A/dm^2$, washing and drying to form a film of MnOOH (manganic hydroxide) free from chromium.

For comparison, similar steel strips were zinc-coated and Fe-Zn alloy coated in various thicknesses, and salt spray tests (JIS Z2371) were conducted to determine the corrosion resistance of the steel substrates as coated. The test results are shown in Table 4, in which the test pieces marked with ⊙ represent the coated steels according to the present invention. As clearly demonstrated, the steel materials having at least about 0.6μ manganese coating and the film of MnOOH (manganese hydroxide) formed thereon show very excellent corrosion resistance in long time tests lasting 2000 hours.

EXAMPLE 2

Cold rolled steel strips of 0.8 mm thick were plated respectively with nickel, copper, zinc, chromium, tin and leadtin alloy by a commercially used method (electrolytic plating or hot dipping), and subjected to the manganese plating in the same way as in Example 1, and an immersion treatment in 10% chromic acid anhydride aqueous solution for 1 to 10 seconds followed by washing and drying to obtain steel strips having a three-layer coating composed of the uppermost layer of MnOOH (manganic hydroxide), the manganese or manganese alloy layer and the layer of the above metal or alloy.

Comparative tests were conducted on these three-layer coated steel strips for determining the corrosion resistance in salt spray tests, in comparison with ordinary metal coated steel materials, such as nickel-plated and copper-plated steel materials. The test results are shown in Table 5.

As clearly shown by the results in Table 5, no change in the behavior of the manganese and the MnOOH (manganic hydroxide) is seen even when other metals or alloys are coated electrolytically or by hot dipping on the steel materials for the purpose of improving the corrosion resistance, and the coating of manganese and MnOOH (manganic hydroxide) applied thereon can still further improve the corrosion resistance as compared with the single metal or alloy coating.

EXAMPLE 3

Cold rolled steel strips of 0.8 mm thick were manganese plated and a film of MnOOH (manganic hydroxide) was formed on the manganese coating in the same way as in Example 1, and folding tests were conducted to determine the peeling off of the manganese coating and the film of MnOOH (manganic hydroxide) at the folded portion in comparison with the same comparative coated steel materials as used in Example 1. The test results are shown in Table 6, from which it is clear that satisfactory workability is assured by the coated steel material according to the present invention up to about 8μ thick of the manganese coating and the film of MnOOH (manganic hydroxide).

Meanwhile, the scratches by the press die are far less in the surface coated steel strips according to the present invention (Table 6, steel materials 2, 4, 6, etc.) than in the comparative materials, and when 1 g/m$^2$ of ordinary synthetic oil lubricant is applied, resistance to the die scratch as good as a cold rolled steel sheet can be obtained. Further, their spot-weldability was tested by a single spot-welding which was performed on two sheets by using an electrode of 4.5 mm diameter corresponding to RWMA class 2 material, with a pressure of 200 kg, and 10 cycles of current passage. In the spot-welding test, the spot-weldability was determined by using the number of spots which could be continuously welded before the strength of the welded portion lowered. The welding tests were conducted under the most severest conditions using the two-side coated steel materials. The test results are shown in Table 6.

As clearly shown by the test results, the steel material according to the present invention shows far better weldability than the zinc-coated steel materials.

EXAMPLE 4

Cold rolled steel strips of 0.8 mm thick were zinc plated in various thicknesses in an electrolytic bath of 350 g/l of zinc sulfate, and 25 g/l of ammonium sulfate at a bath temperature of 40° C., a current density of 30 A/dm$^2$ and with a lead electrode. The zinc coated steel strips thus obtained were, after washing, manganese plated in various thickness in a plating bath of 120 g/l manganese sulfate, 75 g/l of ammonium sulfate, and 60 g/l of ammonium thiocyanate at a bath temperature of 30° C., and a current density of 25 A/dm$^2$ using a lead electrode, and subjected to an immersion treatment in 10% chromic acid anhydride aqueous solution for 1 to 10 seconds, followed by washing and drying to form a film of MnOOH (manganic hydroxide). Comparative corrosion tests were conducted by the salt spray test (JIS Z2371) using zinc-coated steel sheets and zinc-iron alloy coated steel sheets. The test results are shown in Table 7.

As clearly shown by the results in Table 7, the steel sheets coated with zinc in 0.4μ or thicker and manganese and MnOOH (manganic hydroxide) in 0.4μ or thicker according to the present invention show excellent corrosion resistance.

EXAMPLE 5

Cold rolled steel strips of 0.8 mm thick were coated with manganese and MnOOH (manganic hydroxide) in a similar way as in Example 4 and subjected to bending tests to determine the adhesion of the manganese coating and the film of MnOOH (manganic hydroxide) at the bent portions. The results are shown in Table 7.

The results reveal that satisfactory workability can be assured up to about 8μ thick manganese and MnOOH (manganic hydroxide) and up to about 8.4μ thick zinc coating, beyond these thicknesses slight peeling off of the coating takes place.

When further coated with an oil, such as a long-chain fatty acid lubricant in 0.5 to 5 g/m$^2$ by a roll coating method, resistance to die scratching as good as that of an ordinary cold rolled steel sheet can be obtained.

EXAMPLE 6

Cold rolled steel strips were zinc coated in 1.4μ, 4μ and 14μ thick under the same conditions as in Example 4, and further coated with manganese in 0.5μ, 1.4μ and 3μ thick under the same conditions as in Example 1, and further subjected a cathodic electrolytic treatment in 5% chromic acid anhydride aqueous solution at 1 to 5 A/dm$^2$, followed by washing and drying to form a film of MnOOH (manganic hydroxide). These coated steel strips were subjected to the severest welding tests by spot-welding two-side plated steel sheets. The spot-welding was performed on two sheets by using a conical electrode of 4.5 mm diameter corresponding to RWMA class 2, with a pressure of 200 kg and 10 cycles of current passage. In the spot-welding, the number of welding which could be made before the strength of the welded portion lowered, and the proper range of welding current were determined. The test pieces for measuring the strength were prepared according to JIS Z3136. The results are shown in Table 8. The upper limit of the proper range of welding current was set at a point where "splashing" takes place, and the lower limit was set at a point where as satisfactory nugget was formed.

As clearly shown by the results, when the steel strip is coated only with zinc, the proper welding range shifts toward the high current side as the zinc coating increases in thickness, while when the manganese coating with the film of MnOOH (manganic hydroxide) is formed on the zinc coating, the proper welding range shifts to the low current side as the coating increases in thickness and coincides with that for a cold rolled steel sheet, thus facilitating the welding operation. Also the number of consecutive welding of the coated steel sheet according to the present invention is almost the same as that of a cold rolled steel sheet, which indicates very excellent weldability.

When further coated with a rust preventing oil (JIS NP3) in 0.3 to 3 g/m$^2$ by a roll coating method, the so-called electrode contamination is markedly reduced and welding performance as good as that of a cold rolled steel sheet can be obtained.

EXAMPLE 7

Figure 2A:
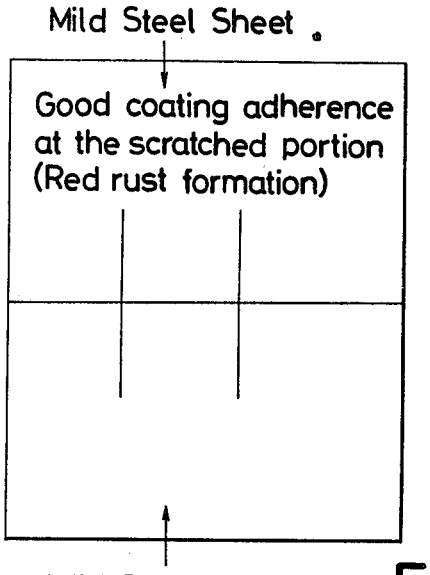
FIGS. 2(*a*), (*b*) and (*c*) show respectively the deterioration of paint coating due to contact corrosion.
Figure 2B:
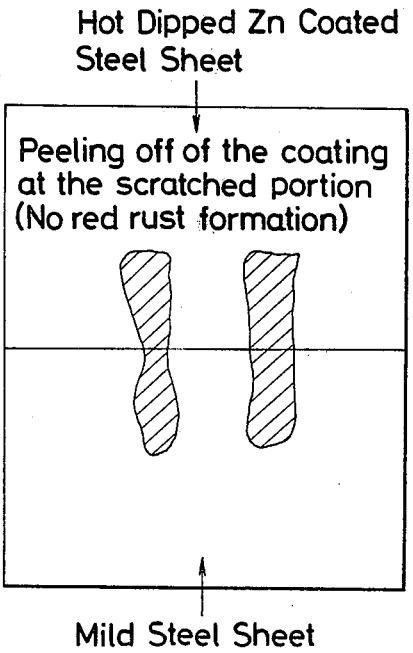
Figure 2C:
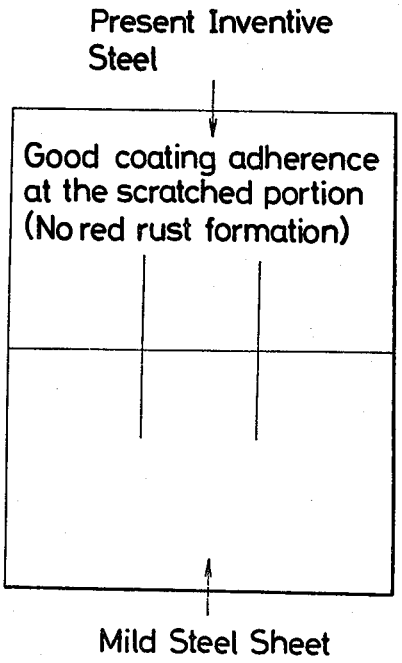

As shown in FIG. 1, a cold rolled steel sheet was assembled with a zinc coated steel sheet, a cold rolled steel sheet was assembled with a zinc-iron alloy coated steel sheet, and a cold rolled steel sheet was assembled with the surface coated steel sheet (Zn 1μ+Mn-MnOOH 1μ) according to the present invention respectively by spot-welding, and these assembled steel sheets were subjected to a standard phosphate treatment, an anionic electrodeposition coating and an upper coating to prepare test pieces, which were scratched across the coatings by a knife to the base steel and subjected to 20-day salt spray tests (JIS Z2371) to determine the adhesion of the coatings near the scratched portions by the tape peeling test. The results are shown in FIG. 2.

No red rust takes place near the welded portions of the zinc coated steel sheet assembled with the cold rolled steel sheet, but apparently the adhesion of the coating lowers and the coating peels off easily by the tape peeling test. Whereas as shown in FIG. 3, there is no peeling off of the coating in the present steel sheet just as in the cold rolled steel sheet, and a satisfactory adhesion of the coating is maintained without formation of red rust at the scratched portions. These results indicate that the surface coated steel sheet according to the present invention can effectively prevent the corrosion caused by contact with different metals.

EXAMPLE 8

Test pieces were prepared from steel sheets coated with manganese, or manganese having a film of MnOOH (manganic hydroxide) thereon, various intermediate coatings and paint coatings, and were scratched with cross-cut and then subjected to one-week salt spray tests to determine the red rust generation and the swelling of coatings at the cross-cut portions. The results are shown in Table 9. The manganese amount contained in the manganese coating, and the amount of P, B, Si, Cu, Mn, Cr, Ni, Co, Fe, Zn, Al, Ca, Mg, Ti, Pb and Sn in the intermediate coating were measured by X-ray fluorescence analysis or chemical analysis. As for the proportion of the amount of resins to the amount of Cr, etc. in the intermediate coating, the amounts in the treating liquids were used, because it was confirmed by experiments that the amounts in the treating liquids were maintained same in the intermediate coatings. The amount of C in the intermediate coating was determined by electron spectrometrically while the uppermost coating was measured by a magnetic method or by cross-sectional observation using an optical microscope.

In Table 9, "and" used for the intermediate coating and the uppermost coating means a mixed layer and "+" means overlapped two layers. The steel materials No. 2 to No. 34 represent the present invention. The steel material No. 1 which was coated with zinc but no manganese shows poor corrosion resistance at the cross-cut portions and is susceptible to red rust.

Whereas the surface coated steel materials according to the present invention show good corrosion resistance at the cross-cut portions, and are not susceptible to red rust and to the swelling of the coatings at the scratched portions. Therefore, the surface coated steel materials according to the present invention have marked advantages due to their excellent corrosion resistance at portions where the coating is scratched.

TABLE 4

| | Test Pieces | Corrosion Resistance (Salt Spray Test JIS-Z-2371) Thickness of Coatings | Thickness of Mn Coating | Thickness of MnOOH (manganic hydroxide) | Salt Spray Test 250hrs. | 500hrs. | 1,000hrs. | 2,000hrs. |
|---|---|---|---|---|---|---|---|---|
| A | Cold Rolled Steel Sheet | — | — | — | XXX | XXX | XXX | XXX |
| B | Galvanized Steel Sheet | Zn 3μ | — | — | XX | XX | XXX | XXX |
| C | Galvanized Steel Sheet | Zn 4μ | — | — | XX | XX | XXX | XXX |
| D | Hot Dipped Zn Coated Steel Sheet | Zn 14μ | — | — | XX | XX | XXX | XXX |
| E | Hot Dipped Zn Coated Steel Sheet | Zn 20μ | — | — | XX | XX | XXX | XXX |
| F | Zn—Fe Alloy coated Steel Sheet | Zn—Fe 8μ | — | — | X | X | XX | XXX |
| G | Zn—Mo—Co Composite coated Steel Sheet | Zn—Mo—Co 8μ | — | — | X | X | XX | XXX |
| H | Manganese coated Steel Materials | — | 0.4μ | — | ○ | X | XX | XX |
| I | Manganese coated Steel Materials | — | 0.6μ | — | ○ | Δ | X | X |
| J | Manganese coated Steel Materials | — | 1.0μ | — | ○ | ○ | ○ | ○ |
| K | Manganese coated Steel Materials | — | 0.4μ | 80Å | ○ | Δ | X | XX |
| ◎ L | Manganese coated Steel Materials | — | 0.6μ | 120Å | ○ | ○ | ○ | X |
| ◎ M | Manganese coated Steel Materials | — | 1.0μ | 150Å | ○ | ○ | ○ | ○ |
| ◎ O | Manganese coated Steel Materials | — | 4.0μ | 150Å | ○ | ○ | ○ | ○ |
| ◎ P | Manganese coated Steel Materials | — | 6.0μ | 170Å | ○ | ○ | ○ | ○ |
| ◎ Q | Manganese coated Steel Materials | — | 8.0μ | 240Å | ○ | ○ | ○ | ○ |

Remarks:
○: Good
Δ: Less than 10% rust formation
X: Less than 30% rust formation
XX: Less than 60% rust formation
XXX: Red rust on the whole surface

TABLE 5-1

| Effects of Base Metallic Coating on Corrosion Resistance | Composition & Thickness | Thickness of Upper-Coated | Thickness of Uppermost Film of MnOOH |
|---|---|---|---|

-continued

| | | Test Piece | of Base Metallic Coatings (μ) | Manganese (μ) | (manganic compound) (A) | Salt Spray Test 1,000 hrs. | Salt Spray Test 2,000 hrs. |
|---|---|---|---|---|---|---|---|
| ◎ | 1 | Mn Coated Steel Sheet | — | 1.0 | 120 | ○ | ○ |
| | 2 | Ni Coated Steel Sheet | Ni 1 | — | — | XXX | XXX |
| ◎ | 3 | Ni + Mn Coated Steel Sheet | " | 0.5 | 100 | ○ | ○ |
| ◎ | 4 | Ni + Mn Coated Steel Sheet | " | 1.0 | 140 | ○ | ○ |
| | 5 | Cu Coated Steel Sheet | Cu 1 | — | — | XXX | XXX |
| ◎ | 6 | Cu + Mn Coated Steel Sheet | " | 0.5 | 130 | ○ | ○ |
| ◎ | 7 | Cu + Mn Coated Steel Sheet | " | 1.0 | 100 | ○ | ○ |
| | 8 | Galvanized Zn Steel Sheet | Zn 3 | — | — | XXX | XXX |
| ◎ | 9 | Zn + Mn Coated Steel Sheet | " | 0.5 | 150 | ○ | ○ |
| ◎ | 10 | Zn + Mn Coated Steel Sheet | " | 1.0 | 120 | ○ | ○ |
| | 11 | Cr Coated Steel Sheet | Cr 0.1 | — | — | XXX | XXX |
| ◎ | 12 | Cr + Mn Coated Steel Sheet | " | 0.5 | 180 | ○ | ○ |
| ◎ | 13 | Cr + Mn Coated Steel Sheet | " | 1.0 | 130 | ○ | ○ |

TABLE 5-2

| | | | | | | | |
|---|---|---|---|---|---|---|---|
| | 14 | Sn Coated Steel Sheet | Sn 1.4 | — | — | XXX | XXX |
| ◎ | 15 | Sn + Mn Coated Steel Sheet | " | 0.5 | 150 | ○ | ○ |
| ◎ | 16 | Sn + Mn Coated Steel Sheet | " | 1.0 | 90 | ○ | ○ |
| | 17 | Pb—Sn Coated Steel Sheet | Pb—Sn 4 | — | — | XX | XXX |
| ◎ | 18 | Pb—Sn + Mn Coated Steel Sheet | " | 0.5 | 180 | ○ | ○ |
| ◎ | 19 | Pb—Sn + Mn Coated Steel Sheet | " | 1.0 | 160 | ○ | ○ |
| | 20 | Al Coated Steel Sheet | Al 10 | — | — | XXX | XXX |
| ◎ | 21 | Al + Mn Coated Steel Sheet | " | 0.5 | 80 | ○ | ○ |
| ◎ | 22 | Al + Mn Coated Steel Sheet | " | 1.0 | 120 | ○ | ○ |

Remarks:
"Mn coated steel sheet" means a manganese coated steel sheet on which the film of MnOOH (manganic hydroxide) is intentionally formed.
○: Good
Δ: Less than 10% rust formation
X: Less than 30% rust formation
XX: Less than 60% rust formation
XXX: Red rust on the whole surface

TABLE 6-1

Comparison of Workability and Spot-Weldability

| | Test Piece | Thickness of Coating (μ) | Thickness of Mn Coating (μ) | Thickness of Uppermost Film of MnOOH (manganic hydroxide) (A) | Folding Test | Number of Spot-Welding |
|---|---|---|---|---|---|---|
| 1 | Cold Rolled Steel Sheet | — | — | — | | More than 15,000 |
| 2 | Galvanized Zn Coated Steel Sheet | Zn 3 | — | — | | 9,600 |
| 3 | Galvanized Zn Coated Steel Sheet | Zn 4 | — | — | | 8,000 |
| 4 | Hot-Dipped Zn Coated Steel Sheet | Zn 14 | — | — | Δ | 2,700 |
| 5 | Hot-Dipped Zn Coated Steel Sheet | Zn 20 | — | — | Δ | 2,200 |
| 6 | Zn—Fe Alloy Coated Steel Sheet | Zn—Fe 6 | — | — | X | 12,000 |
| 7 | Zn—Fe Alloy Coated Steel Sheet | Zn—Fe 8 | — | — | X | 10,000 |
| 8 | Zn—Mo—Co Composite Coated Steel Sheet | Zn—Mo—Co 8 | — | — | | 10,000 |
| 9 | Ni Coated Steel Sheet | Ni 1 | — | — | | More than 15,000 |
| 10 | Cu Coated Steel Sheet | Cu 1 | — | — | | More than 15,000 |

TABLE 6-2

-continued

| | | | | | | |
|---|---|---|---|---|---|---|
| 11 | Cr Coated Steel Sheet | Cr 0.1 | — | — | ○ | 10,000 |
| 12 | Sn Coated Steel Sheet | Sn 1.4 | — | — | ○ | More than 15,000 |
| 13 | Pb—Sn Coated Steel Sheet | Pb—Sn 4 | — | — | ○ | More than 15,000 |
| 14 | Al - Coated Steel Sheet | Al 109 | — | — | Δ | 2,000 |
| 15 | Mn Coated Steel Sheet | — | Mn 0.4 | — | ○ | More than 15,000 |
| 16 | " | — | Mn 0.6 | — | ○ | More than 15,000 |
| 17 | " | — | Mn 1.0 | — | ○ | More than 15,000 |
| 18 | " | — | Mn 0.4 | 80 | ○ | More than 15,000 |
| ◎19 | " | — | Mn 0.6 | 120 | ○ | More than 15,000 |
| ◎20 | " | — | Mn 1.0 | 150 | ○ | More than 15,000 |

TABLE 6-3

| | | | | | | |
|---|---|---|---|---|---|---|
| ◎21 | Mn Coated Steel Sheet | — | Mn 4.0 | 150 | ○ | More than 15,000 |
| ◎22 | " | — | Mn 6.0 | 170 | ○ | More than 15,000 |
| ◎23 | " | — | Mn 8.0 | 240 | ○ | More than 15,000 |
| ◎24 | Ni + Mn Coated Steel Sheet | Ni 1 | Mn 1 | 140 | ○ | More than 15,000 |
| ◎25 | Cu + Mn Coated Steel Sheet | Cu 1 | Mn 1 | 100 | ○ | More than 15,000 |
| ◎26 | Zn + Mn Coated Steel Sheet | Zn 3 | Mn 1 | 120 | ○ | More than 15,000 |
| ◎27 | Sn + Mn Coated Steel Sheet | Sn 1.4 | Mn 1 | 130 | ○ | More than 15,000 |
| ◎28 | Pb—Sn + Mn Coated Steel Sheet | Pb—Sn 4 | Mn 1 | 160 | ○ | More than 15,000 |
| ◎29 | Al + Mn Coated Steel Sheet | Al 10 | Mn 1 | 120 | Δ | 7,000 |

○: Good
Δ: Slightly peeling off

TABLE 7

| No. | Test Piece | Thickness of Zn coating (μ) | Thickness of Mn coating (μ) | Thickness of Uppermost Film of MnOOH (manganic hydroxide) (A) | Salt Spray Test 250hrs. | 500hrs. | 1,000hrs. | 2,000hrs. | Adhesion of coatings at bent portions |
|---|---|---|---|---|---|---|---|---|---|
| 1 | Galvanized Zn Coated Steel Sheet | 3 | — | — | XX | XX | XXX | XXX | ○ |
| 2 | Galvanized Zn Coated Steel Sheet | 4 | — | — | XX | XX | XXX | XXX | ○ |
| 3 | Hot-Dipped Zn Coated Steel Sheet | 14 | — | — | XX | XX | XXX | XXX | Δ |
| 4 | Hot-Dipped Zn Coated Steel Sheet | 20 | — | — | XX | XX | XXX | XXX | Δ |
| 5 | Zn—Fe Alloy Coated Steel Sheet | Zn—Fe 8 | — | — | X | X | XX | XXX | X |
| 6 | Composite Coated Steel Sheet | 0.2 | 1.0 | 150 | ○ | ○ | ○ | ○ | X |
| ◎ 7 | Composite Coated Steel Sheet | 0.4 | 1.0 | 130 | ○ | ○ | ○ | ○ | ○ |
| ◎ 8 | Composite Coated Steel Sheet | 3.5 | 1.0 | 150 | ○ | ○ | ○ | ○ | ○ |
| ◎ 9 | Composite Coated Steel Sheet | 8.4 | 1.0 | 170 | ○ | ○ | ○ | ○ | ○ |
| 10 | Composite Coated Steel Sheet | 11 | 1.0 | 230 | ○ | ○ | ○ | ○ | Δ |
| 11 | Composite Coated Steel Sheet | 1.4 | 0.2 | 50 | ○ | Δ | X | X | ○ |

TABLE 7-continued

| No. | Test Piece | Thickness of Zn coating (μ) | Thickness of Mn coating (μ) | Thickness of Uppermost Film of MnOOH (manganic hydroxide) (A) | Salt Spray Test 250hrs. | 500hrs. | 1,000hrs. | 2,000hrs. | Adhesion of coatings at bent portions |
|---|---|---|---|---|---|---|---|---|---|
| ◎ 12 | Composite Coated Steel Sheet | 1.4 | 0.4 | 140 | ○ | ○ | Δ | X | ○ |
| ◎ 13 | Composite Coated Steel Sheet | 1.4 | 1.0 | 180 | ○ | ○ | ○ | ○ | ○ |
| ◎ 14 | Composite Coated Steel Sheet | 1.4 | 3 | 210 | ○ | ○ | ○ | ○ | ○ |
| ◎ 15 | Composite Coated Steel Sheet | 1.4 | 7 | 180 | ○ | ○ | ○ | ○ | ○ |
| 16 | Composite Coated Steel Sheet | 1.4 | 8.5 | 190 | Δ | ○ | ○ | ○ | Δ |

TABLE 8

| Thickness of MnOOH(manganic hydroxide) (A) | | Welding Current (kA) 6 7 8 9 10 | Number of Weld |
|---|---|---|---|
| Cold Rolled Steel Sheet | — | ⟷ | |
| Zn Coating 1.4μ | — | ⟷ | |
| Zn Coating 4μ | — | ⟷ | |
| Zn Coating 14μ | — | ⟷ | |

TABLE 8-continued

| Thickness of MnOOH(manganic hydroxide) (A) | | Welding Current (kA) 6 7 8 9 10 | Number of Weld |
|---|---|---|---|
| Zn 1.4μ + Mn 0.5μ | 150 | ⟷ | |
| Zn 1.4μ + Mn 1.4μ | 210 | ⟷ | |
| Zn 1.4μ + Mn 3μ | 240 | ⟷ | |

TABLE 9-1

Corrosion Resistance of Various Surface Coated Steel Materials

| No. | Sizes of Steel Materials (mm) | Base Coatings ($g/m^2$) | Lower Coating: Mn Coating ($g/m^2$) | Lower Coating: Thickness of MnOOH (manganic hydroxide (A) | Intermediate Coating | Upper Coating (μ) | Corrosion Resistance By One-Week Salt Spray Test: Cross-Cut Portions | Portions with no Scratching Point Coating |
|---|---|---|---|---|---|---|---|---|
| *1 | Steel 0.8 × 914 × 1219 | Zn 25 | None | None | Zinc phosphate (P: 0.2g/$m^2$) | Acrylic resin 5 | X | X |
| 2 | Steel 0.8 × 914 × 1219 | None | 10 | None | Zinc phosphate (P: 0.2g/$m^2$) | Acrylic resin 5 | | |
| 3 | Steel 0.8 × 914 × 1219 | Zn 10 | 10 | 120 | Chromic chromate (Cr: 14mg/$m^2$) | Acrylic resin 20 + Epoxy resin 40 | | |
| 4 | Steel 0.8 × 914 × 1219 | " | 5.5 | 120 | Chromic chromate (Cr: 14mg/$m^2$) and Polyethylene (Cr × 1.0) | Acrylic resin 20 + Epoxy resin 40 | | |
| 5 | Steel 0.8 × 914 × 1219 | " | 10 | 130 | Chromic chromate (Cr: 5mg/$m^2$) and Zinc phosphate (P: 0.2 g/$m^2$) | Acrylic resin 20 + Epoxy resin 40 | | |
| 6 | Steel 0.8 × 914 × 1219 | " | 10 | 130 | Chromic chromate (Cr: 0.24mg/$m^2$) and Acrylic resin (Cr × 2.0) | Acrylic resin 20 + Epoxy resin 40 | | |
| 7 | Steel 0.8 × 914 × 1219 | " | 10 | 130 | Chromic chromate (Cr: 10mg/$m^2$) and Titanium oxide (Ti: 3mg/$m^2$) | Polyester 140 | | |
| 8 | Steel 0.8 × 914 × 1219 | " | 10 | 1000 | Chromic chromate (Cr: 1.0mg/$m^2$) and Polyester (Cr × 0.022) | " | | |
| 9 | Steel 0.8 × 914 × 1219 | " | 10 | 10 | Chromic chromate (Cr: 20mg/$m^2$) & Acrylic resin (Cr × 1.2) | Acrylic resin 20 + Epoxy resin 40 | | |
| 10 | Steel 0.8 × 914 × 1219 | Fe—Zn 45 | 80 | 10 | Chromic chromate (Cr: 230mg/$m^2$) and Acrylic resin (Cr × 4.2) | Acrylic resin 20 + Epoxy resin 40 | | |
| 11 | Steel 0.8 × 914 × 1219 | Fe—Zn 45 | 32 | None | Lead chromate (Cr: 230mg/$m^2$) and Acrylic resin (Cr × 4.2) | Epoxy resin and Pigment 0.23 | | |

TABLE 9-2

| | | | | | | | | |
|---|---|---|---|---|---|---|---|---|
| 12 | Steel 0.7 × 1219 × coil | Zn 10 | 20 | None | Aluminum oxide (Al: 0.1g/$m^2$) and $Fe_3O_4$ (Fe: 0.1g/$m^2$) | Polybutadiene 15 + Melamine resin 60 | | |
| 13 | Steel 0.7 × 1219 × coil | " | 5.6 | 120 | Iron-Zinc phosphate and Calcium phosphate (P: 0.3g/$m^2$) & Tin oxide (Sn: 0.1g/$m^2$) | Polybutadiene 15 + Melamine resin 60 | | |
| 14 | Steel | Al 12 | 10 | None | Aluminum hydroxide (P: 0.024g/$m^2$) | Polybutadiene 15 | | |

-continued

| | | | | | | |
|---|---|---|---|---|---|---|
| | 0.7 × 1219 × coil | | | | and Nickel oxide (Ni: 0.1g/m$^2$) | + Melamine resin 60 |
| 15 | Steel 0.7 × 1219 × coil | " | 10 | None | Zinc phosphate (P: 0.24g/m$^2$) and Copper oxide (Cu: 0.03g/m$^2$) | Polybutadiene 15 30 Melamine resin 60 |
| 16 | Steel 0.7 × 1219 × coil | Zn 60 | 34 | 200 | Sodium silicate (Si: 2g/m$^2$) and Boron oxide (B: 1g/m$^2$) | Polybutadiene 15 + Melamine resin 60 |
| 17 | Steel 0.7 × 1219 × coil | " | 34 | None | Iron phosphate, zinc and Manganese phosphate (P: 0.25g/m$^2$) | Melamine resin and Pigment 0.24 |
| 18 | Steel 0.7 × 1219 × coil | Zn 10 | 10 | None | Calcium phosphate, Nickel phosphate, Copper phosphate and Magnesium phosphate (P: 1.8g/m$^2$) | Polyvinylacetate 25 |
| 19 | Steel 0.7 × 1219 × coil | " | 12 | 100 | Zinc phosphate (P: 0.2g/m$^2$) + Chromic chromate (Cr: 8mg/m$^2$) | Polyethylene 30 |
| 20 | Steel 0.7 × 1219 × coil | " | 5.6 | None | Zinc phosphate (P: 0.2g/m$^2$) + Chromic chromate (Cr: 8mg/m$^2$) | " |
| 21 | Wire Stock 1ϕ × coil | " | 10 | None | Iron phosphate, Zinc (P: 0.2g/m$^2$) + Chromic chromate (Cr: 3mg/m$^2$) | " |
| 22 | Wire Stock 1ϕ × coil | " | 10 | None | Iron phosphate, Zinc (P: 0.012g/m$^2$) + Chromic chromate (Cr: 3mg/m$^2$) | " |
| 23 | Bar 9ϕ × 6,000 | " | 18 | None | Calcium oxalate (Ca: 1.2g/m$^2$) and Cobalt oxide (Co: 0.3g/m$^2$) | Polyethylene 240 |

TABLE 9-3

| | | | | | | |
|---|---|---|---|---|---|---|
| 24 | Bar 9ϕ × 6,000 | Zn 10 | 200 | None | Manganese phosphate (P: 0.24g/m$^2$) + Chromic chromate (Cr: 0.12mg/m$^2$) | Polyethylene 240 |
| 25 | " | " | 29 | None | Calcium phosphate, Magnesium phosphate (P: 1.2g/m$^2$) + Chromic chromate (Cr: 250mg/m$^2$) | Silicon resin and Pigment 50 |
| 26 | " | " | 29 | 200 | Calcium phosphate, Magnesium phosphate (P: 1.2g/m$^2$)$_2$ + Chromic chromate (Cr: 250mg/m$^2$) | Silicon resin and Pigment 0.26 |
| 27 | Strip 0.8 × 1219 × coil | " | 10 | None | Iron phsophate, Zinc (P: 0.3g/m$^2$) + Titanium oxide (Ti: 0.04g/m$^2$) | Epoxy resin 20 + Phenol resin 30 |
| 28 | Strip 0.8 × 1219 × coil | " | 10 | 100 | Iron phosphate, Zinc (P: 0.3g/m$^2$) + Chromic chromate (Cr: 8mg/m$^2$) | Epoxy resin 30 + Phenol resin 30 |
| 29 | Pipe 25.4ϕ × 2,000 | " | 10 | None | Manganese carbonate and Basic manganese carbonate ($CO_3$: 30mg/m$^2$) | Maleic oil and Pigment 20 |
| 30 | Pipe 25.4ϕ × 2,000 | " | 5.6 | None | Manganese carbonate and Basic manganese carbonate ($CO_3$: 30mg/m$^2$) | Maleic oil and Pigment 20 |
| 31 | Reinforcing Wire 9ϕ × 2,000 | " | 10 | 300 | Chromic chromate (Cr: 8mg/m$^2$) and Acrylic resin (Cr × 1.2) | Epoxy resin 1.2 |
| 32 | Reinforcing Wire 9ϕ × 2,000 | " | 10 | None | Basic manganese carbonate ($CO_3$: 2.4mg/m$^2$) | Glycolester of adipic acid 40 |
| 33 | Wire Stock 2ϕ × coil | " | 10 | None | Iron phosphate, Zinc (P: 0.1g/m$^2$) | Epoxy resin 10 |
| 34 | Wire Stock 2ϕ × coil | " | 32 | None | Manganese carbonate ($CO_3$: 80mg/m$^2$) and Zinc oxide (Pb: 0.03g/m$^2$) | Acetylcellulose 0.28 |

*Comparative Steels
: No red rust
: No swelling of coating
X: Red rust
X: Swelling of coating

What is claimed is:

1. A surface treated steel material comprising a manganese coating on the steel material and a film consisting essentially of MnOOH (manganic hydroxide) on the manganese coating.

2. A surface treated steel material according to claim 1, in which the manganese coating is in a thickness not thicker than 8μ and the film of manganic hydroxide is in a thickness ranging from 50 to 300 Å.

3. A surface treated steel material according to claim 1, which further comprises a zinc coating between the base steel and the manganese coating.

4. A surface treated steel material according to claim 3, in which the zinc coating is in a thickness ranging from 0.4μ to 8.4μ.

5. A surface treated steel material according to claim 1, which further comprises a surface coating on the film of the manganic hydroxide, said surface coating containing at least one member selected from the group consisting of P, B, Si, Cu, Mn, Cr, Ni, Co, Fe, Zn, Al, Ca, Mg, Ti, Pb, Sn, inorganic C, and their compounds.

6. A surface treated steel material according to claim 5, in which the surface coating further contains an organic resin.

7. A surface treated steel material according to claim 5, which further comprises an organic coating on the surface coating.

8. A surface treated steel material according to claim 6, which further comprises an organic coating on the surface coating.

9. A surface treated steel material according to claim 3 which further comprises a zinc coating between the base steel and the manganese coating, the zinc coating having a thickness ranging from 0.4μ to 8.4μ.

* * * * *